US007435148B2

(12) United States Patent
Clark

(10) Patent No.: US 7,435,148 B2
(45) Date of Patent: Oct. 14, 2008

(54) HYDROSTATIC EPIRB RELEASE

(75) Inventor: Mark Clark, Loxahatchee, FL (US)

(73) Assignee: ACR Electronics, Inc., Fort Lauderdale, FL (US)

( * ) Notice: Subject to any disclaimer, the term of this patent is extended or adjusted under 35 U.S.C. 154(b) by 57 days.

(21) Appl. No.: 11/567,580

(22) Filed: Dec. 6, 2006

(65) Prior Publication Data

US 2007/0135002 A1 Jun. 14, 2007

Related U.S. Application Data

(60) Provisional application No. 60/597,544, filed on Dec. 8, 2005.

(51) Int. Cl.
*B63B 22/14* (2006.01)

(52) U.S. Cl. ..... 441/10

(58) Field of Classification Search ..... 441/10
See application file for complete search history.

(56) References Cited

U.S. PATENT DOCUMENTS 3,229,292 A * 1/1966 Dell Aria et al. ..... 342/8
4,040,135 A * 8/1977 Arnold ..... 441/10
4,262,702 A * 4/1981 Streich ..... 138/89
5,365,873 A * 11/1994 Wigram ..... 114/367
6,878,024 B1 * 4/2005 Kohuth ..... 441/10

* cited by examiner

*Primary Examiner*—Stephen Avila
(74) *Attorney, Agent, or Firm*—Malin Haley DiMaggio Bowen & Lhota, P.A.

(57) ABSTRACT

A hydrostatic release for securing an emergency position indicating radio beacon (EPIRB) to a shipboard surface to withstand high G-forces while having a release mechanism that if the ship were to sink will release the EPIRB at a pre-determined water pressure which is equivalent to depth of water. The hydrostatic release includes two shafts mounted end to end and clamped together under spring pressure by a slide that can be moved by a water pressure sensitive diaphragm when the hydrostatic device is underwater and experiences a pre-determined water pressure. The elongated shaft is connected at one end to an EPIRB housing and at the other end to the EPIRB housing cover. Once the cover is released by the water pressure, the EPIRB will float to the ocean surface.

8 Claims, 10 Drawing Sheets

HYDROSTATIC EPIRB RELEASE

BACKGROUND OF THE INVENTION

1. Field of the Invention

This invention relates to an underwater pressure-activated hydrostatic release for physically securing an emergency position indicating radio beacon (EPIRB) to a vessel and physically automatically releasing the EPIRB from the vessel in the event that the vessel sinks.

2. Description of Related Art

An emergency position indicating radio beacon (EPIRB) is a device that transmits signals at radio frequencies to announce an emergency and to help locate the victims of the emergency typically when a boat or a ship sinks. Most often, the EPIRB transmitters are activated upon immersion in water which causes an electric contact to activate the transmitters. The emergency signals can be picked up by satellites, airplanes or other ships in the vicinity while the EPIRB is floating on the surface of the ocean.

When not in use, however, the EPIRB must be securely stored and fastened to a vessel especially because boats and ships are subject to high G-forces due to wave action and the rolling action of the vessel under certain meteorological conditions. Thus, in the absence of an emergency, the EPIRB is typically mounted in a moisture resistant housing since exposure to water immersion can set off the transmitter leading to a false emergency signal. However, if the vessel sinks, water can flow into the moisture resistant EPIRB housing because it is absolutely essential that the EPIRB be released by water pressure from the vessel and from the housing within which it is stored so that the EPIRB can rise to the surface of the ocean and begin transmitting an emergency signal as quickly as possible.

One aspect of the present invention addresses this problem by providing a water pressure activated hydrostatic release that when not activated securely fastens the EPIRB in a secure housing to a vessel and when activated underwater by the surrounding water pressure releases the EPIRB and the secure housing cover based on hydrostatic pressure resulting from underwater pressure. Once the secure housing cover is released underwater, the EPIRB is free to float to the surface.

SUMMARY OF THE INVENTION

The hydrostatic release is its own self-contained unit that can securely connect a first object to a second object mechanically. An EPIRB is securely stored in a protective two piece housing, the base of which is securely fastened to the hull or deck of a ship or boat. The housing base is a receptacle that is large enough to receive the EPIRB and the static release device. The EPIRB housing includes a top cover that fits over the EPIRB and the hydrostatic release device which are stored inside the housing base. The housing cover is secured to the housing base receptacle by connection to the hydrostatic release device, stored inside the housing. Thus, in the stored position, the EPIRB (which floats) rests inside the closed moisture resistant housing along with the hydrostatic release device which is fastened to the housing base and also fastened to the cover, holding the cover securely in place on the housing base. If the ship or vessel attached to the EPIRB housing sinks, the EPIRB housing and its contents also sink underwater. Water is received in the EPIRB housing. At a certain underwater pressure (a certain water depth), the hydrostatic release will be activated which then releases the EPIRB housing cover from the housing base receptacle. Once the housing cover has been released by the hydrostatic release, the EPIRB will float because of its buoyancy to the surface of the ocean or body of water and will begin transmitting emergency signals.

The following description discusses the structure and operation of the hydrostatic release mechanism.

The hydrostatic release includes an elongated vertical shaft that is in two pieces including an upper release pin and a lower base pin that when joined together by a slide includes a first locking flange and a second locking flange. The two piece elongated shaft is held firmly in place as if it were one shaft by the locking pins.

The hydrostatic release includes a compartment having a diaphragm under a first spring tension that moves against the spring due to water pressure on one side releasing a slide mechanism that locks the first and second shaft pieces together. When sufficient water pressure engages the diaphragm, which would be the case when a boat sinks with the hydrostatic device attached thereto and reaches a certain depth of water, there is sufficient water pressure to move the diaphragm on one side against spring tension that releases tension on the slide mechanism which is under a second spring tension. When that happens, the slide moves away from the elongated shaft, disengaging the release pin from the base pin which is secured to the EPIRB housing cover. Once the release pin is free, the upper housing cover of the EPIRB and the EPIRB itself are free to float away. The EPIRB is buoyant and floats to the surface. Once water engulfs the EPIRB, the device will automatically begin transmitting emergency signals.

An object of this invention is to produce an inexpensive, effective, and reliable pressure-activated release mechanism for securing an EPIRB to a vessel and for releasing the EPIRB as the vessel to which the EPIRB is attached begins sinking.

Another object of this invention is to use an apparatus that is activated by changes in pressure or depth for releasing a device, such as an EPIRB, from a vessel rather than using a cutting latch mechanism.

In accordance with these and other objects which will become apparent hereinafter, the instant invention will now be described with particular reference to the accompanying drawings.

DETAILED DESCRIPTION

FIGS. 1 through 6 illustrate the hydrostatic release mechanism 10 for securing an emergency position indicating radio beacon (EPIRB) 12 (FIG. 10) to a vessel 14 (FIG. 11) and for releasing said EPIRB 12 from the vessel during an emergency when said vessel 14 is sinking. The EPIRB is mounted in a protective housing 46 and 48 (FIG. 10) that must be securely fastened to the vessel to prevent release of the EPIRB during high G-motion of the vessel during normal operation of the vessel. The EPIRB must be secured in the protective housing until the emergency.

Figure 1A:
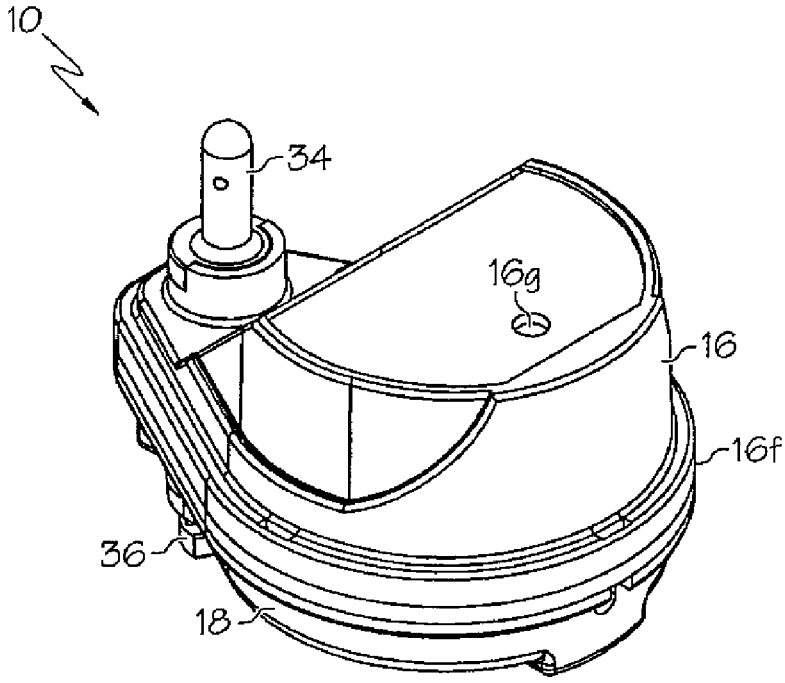
FIG. 1A shows a perspective top view of the hydrostatic release mechanism.
Figure 1B:
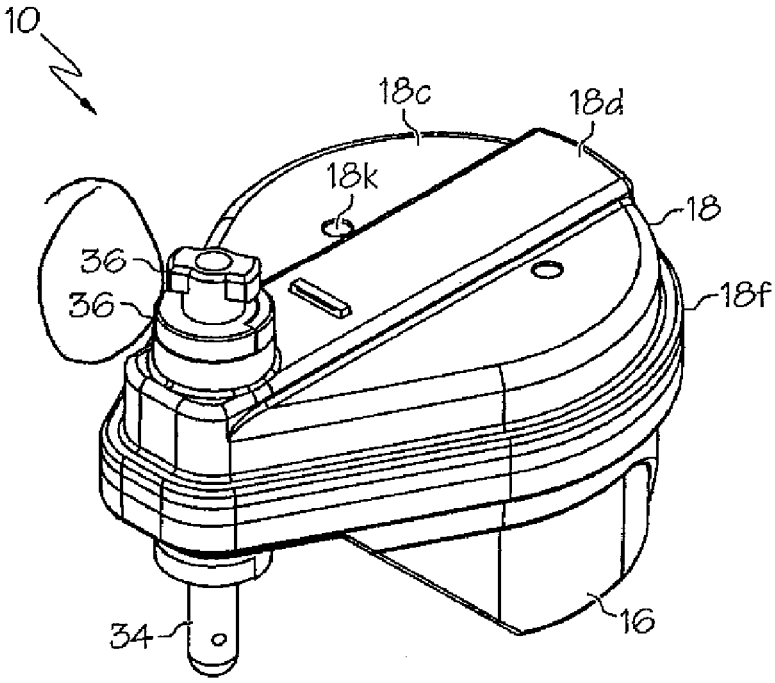
FIG. 1B shows a perspective bottom view of the hydrostatic release mechanism.
Figure 2:
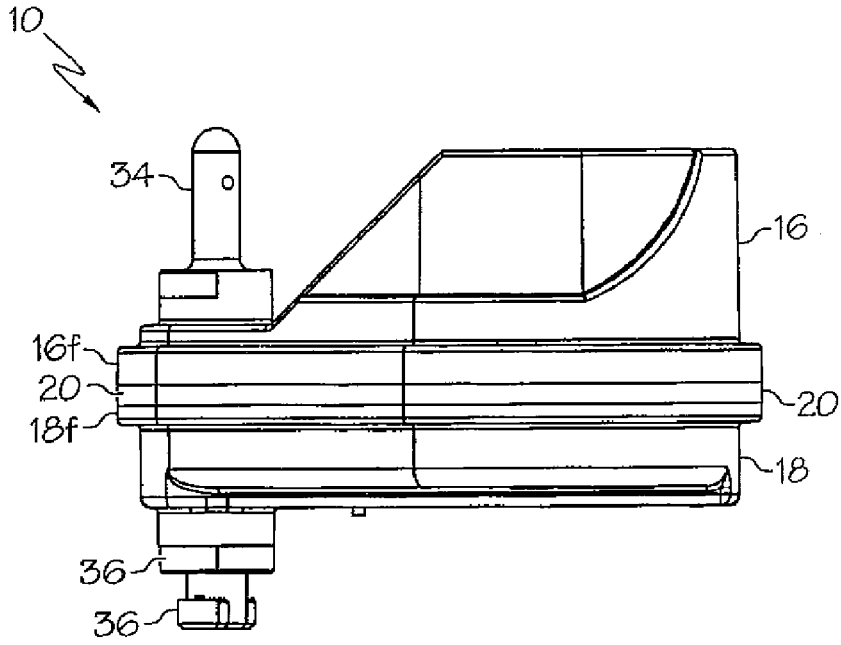
FIG. 2 shows an elevational side view of the hydrostatic release mechanism.
Figure 3:
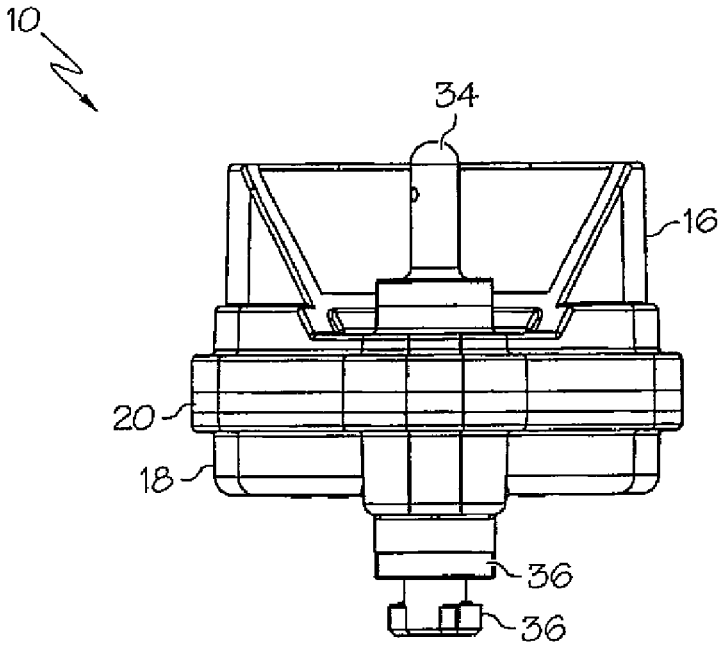
FIG. 3 shows an elevational front view of the hydrostatic release mechanism.
Figure 4:
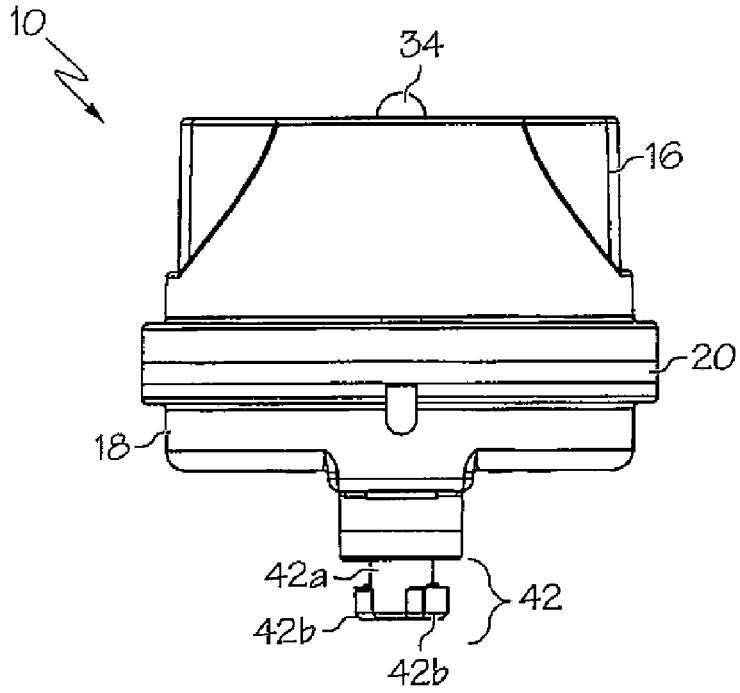
FIG. 4 shows an elevational rear view of the hydrostatic release mechanism.
Figure 5:
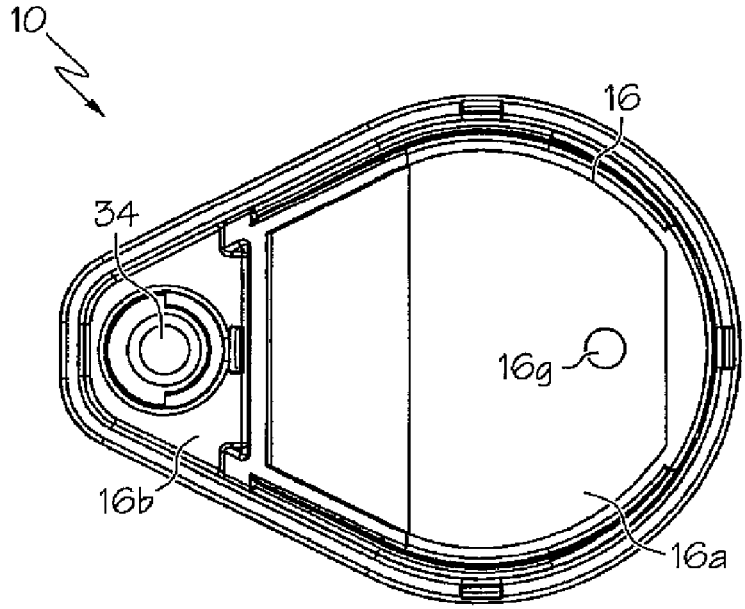
FIG. 5 shows a top plan view of the hydrostatic release mechanism.

The hydrostatic release 10 includes its own housing having a cover 16, a base receptacle 18, a midplate bushing 20, a piston diaphragm assembly 22, a slide spring 24, a slide 26, a diaphragm spring 28, a plug 30, a plug retainer 32, an upper rod 34, a lower rod 36, and a tamper-proof insert 38. The hydrostatic release 10 uses a two-part rod design (upper rod 34 and lower rod 36) to release the EPIRB 12, rather than using knife or razor blades or another cutting action elements as with conventional EPIRB releases. Through a horizontal cross-section, the top housing 16 is substantially pear-shaped, having a round end 16*a* and a tapered end 16*b* as shown in FIG. 5. Similarly, the bottom housing 18 and midplate bushing 20 are also substantially pear-shaped with each having a round end, 18*a* and 20*a* respectively, and a tapered end, 18*b* and 20*b* respectively, so that said top and bottom housings, 16 and 18, and the midplate bushing 20 fit together when aligned geometrically as the hydrostatic release 10 is assembled.

Figure 8:
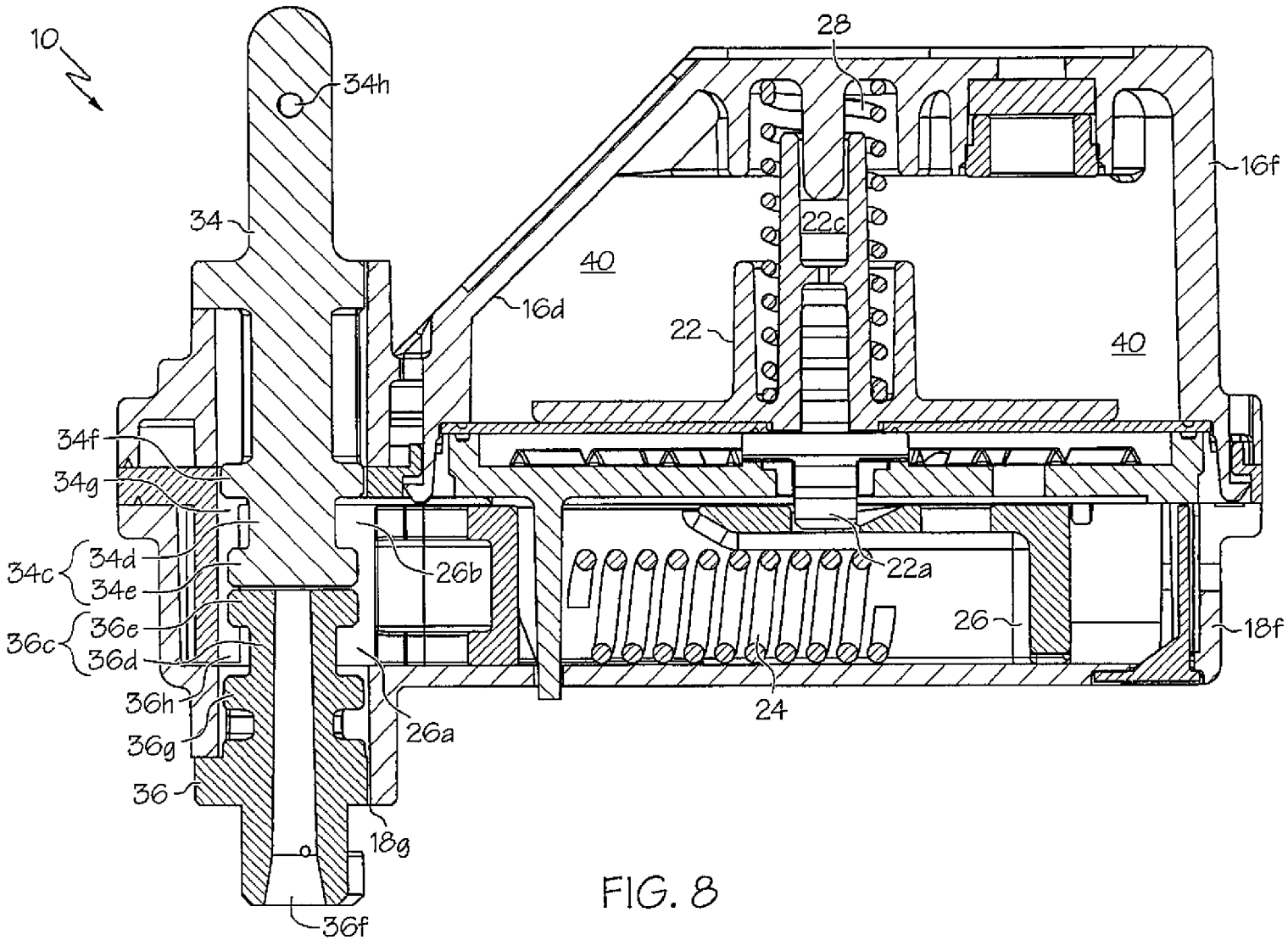
FIG. 8 shows a cross-sectional, elevational, side view of the hydrostatic release mechanism.
Figure 9:
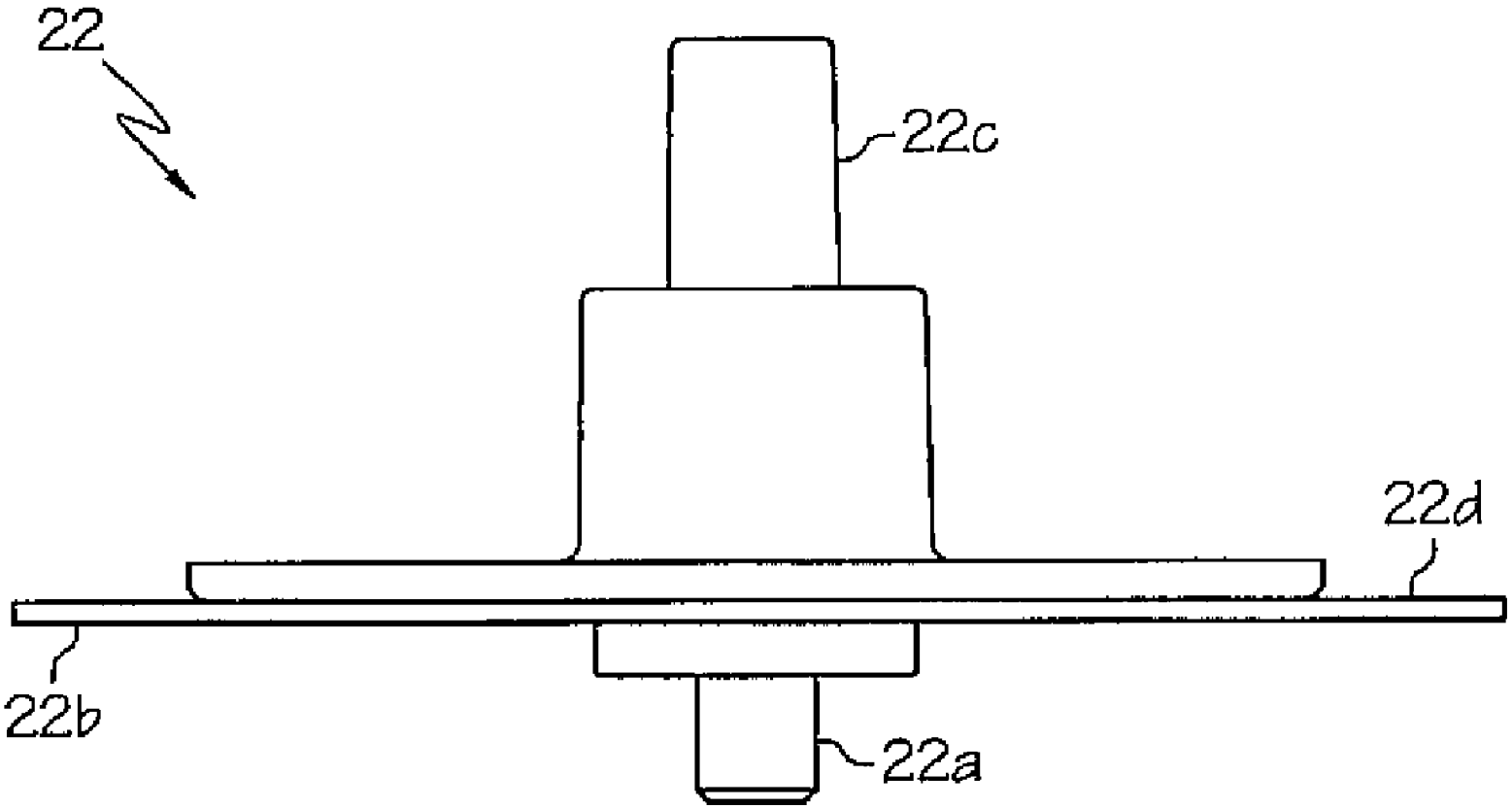
FIG. 9 shows a side elevational view of the piston diaphragm assembly.

In FIG. 5 and FIG. 8, the top housing 16 of the hydrostatic release 10 comprises a recessed interior surface 16*d*, an exterior surface 16*e*, and a side wall 16*f*. The top housing 16 also includes a top housing aperture 16*c*, which is centrally disposed on and passes through the tapered end 16*b* of said top housing 16. A first end 34*a* of the upper rod 34 is inserted into the top housing aperture 16*c* until said first end 34*a* contacts the first end 36*a* of said lower rod 36 as shown in FIG. 8. The top housing 16 is connected securely to the bottom housing 18 in a clam-shell configuration to seal all of the aforementioned components within the hydrostatic release 10. Said top housing 16 further includes an air-breathing aperture 16*g*.

Figure 6:
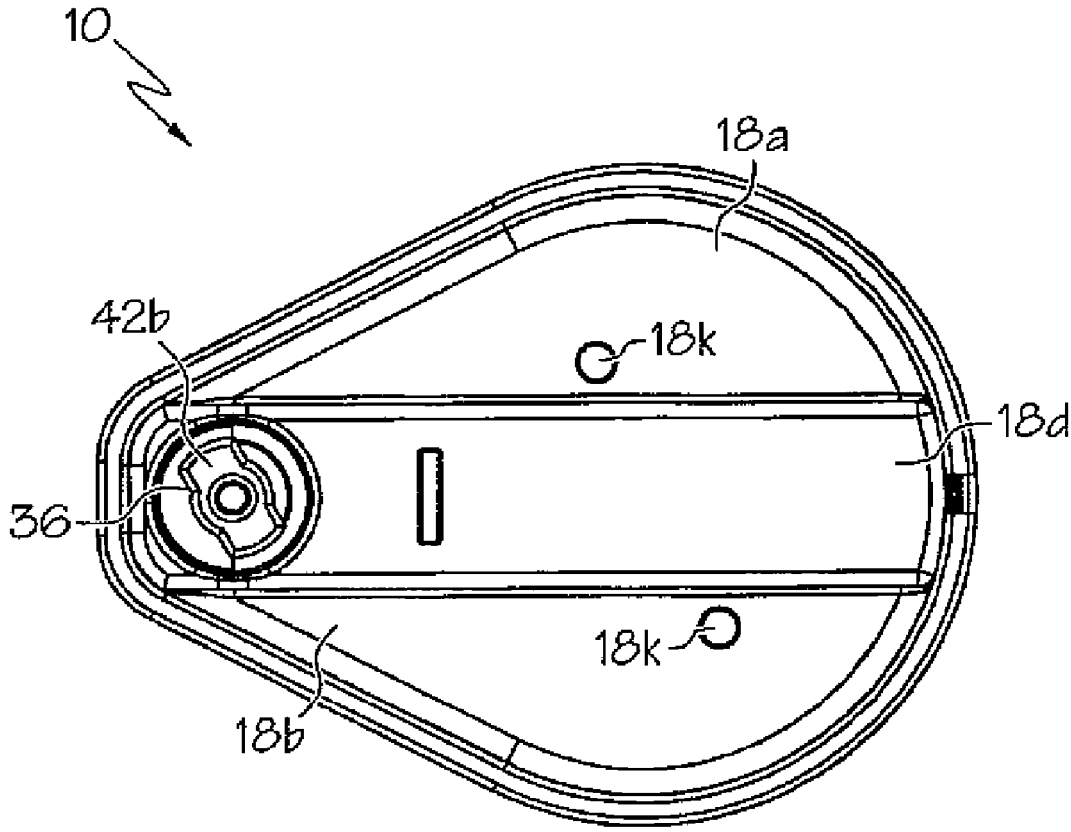
FIG. 6 shows a bottom plan view of the hydrostatic release mechanism.

The bottom housing 18 of the hydrostatic release 10 comprises a planar exterior surface 18*c* having a midline ridge 18*d* and a recessed interior surface 18*e* surrounded by a shallow side wall 18*f* connected at approximately right angles to said interior surface 18*e*. The bottom housing 18 is penetrated by a bottom housing aperture 18*g*, which is centrally disposed on and passes through the tapered end 18*b* of said bottom housing 18. The lower rod 36 is inserted into the bottom housing aperture 18*g*. The bottom housing 18 further includes a channel 18*h* disposed centrally and longitudinally across the interior surface 18*e*. Said channel 18*h* on the interior surface 18*e* of the bottom housing 18 corresponds to and forms the midline ridge 18*d* on the exterior surface 18*c* of the bottom housing 18. The channel 18*h* is constructed of a sufficient size to receive the insertion of slide 26. The slide spring 24 fits within the channel 18*h* and the slide 26 is fitted over the slide spring 24 and within the channel 18*h* of the interior surface 18*e*. Said bottom housing further includes two water-intake apertures 18*k* as shown in FIG. 6.

Figure 7:
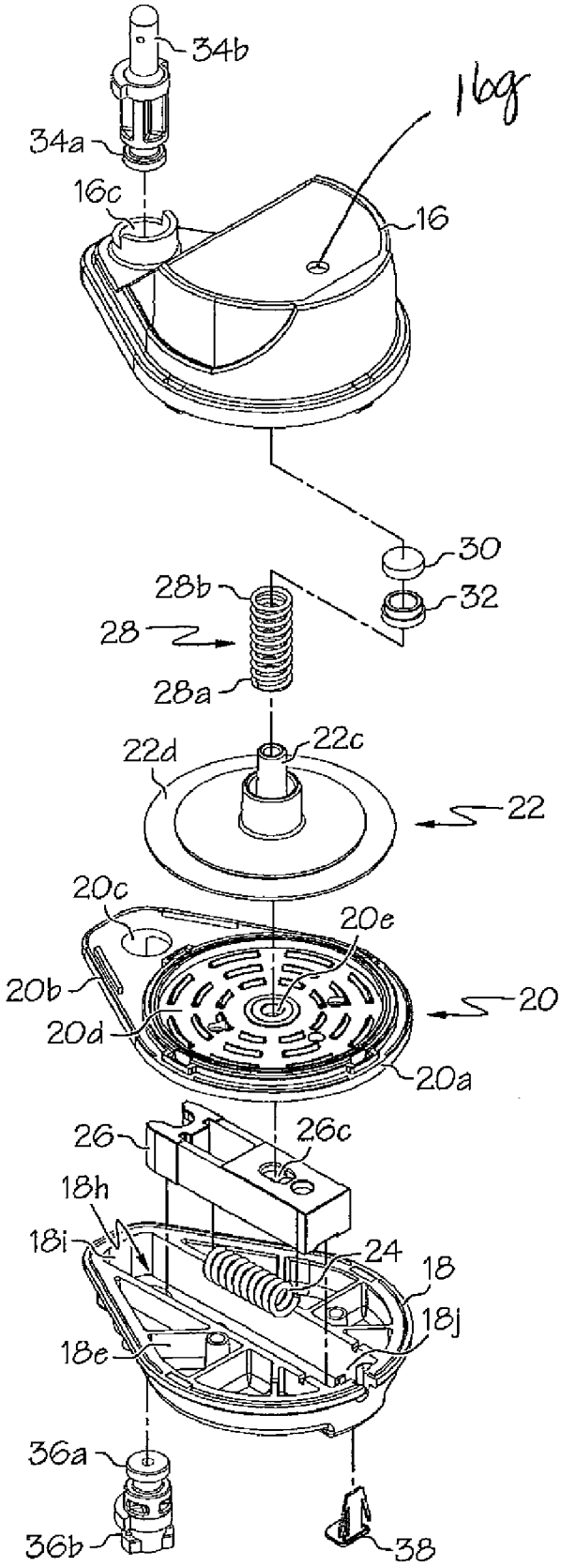
FIG. 7 shows an exploded perspective view of the hydrostatic release mechanism.

The midplate bushing comprises a mostly planar circular portion 20*d* located on the round end 20*a* of said midplate bushing 20, a first aperture, and a centrally-located second aperture 20*e*. The midplate bushing 20 is fitted mostly within an interior void 40, or pressure chamber, formed between the top housing 16 and bottom housing 18 above the slide 26 and slide spring 24 when the assembly of the device 10 is complete. As illustrated in FIG. 7, the first aperture 20*c* of the midplate bushing 20 receives the upper rod 34 that is inserted through the top housing aperture 16*c*. According to FIGS. 2 through 4, the midplate bushing 20 is interposed, or sandwiched, between the top housing 16 and bottom housing 18. The midplate bushing 20 remains visible when the hydrostatic release 10 is fully assembled.

The slide 26, which is fitted over top of the slide spring 24 both of which are seated within the channel 18*h* of the bottom housing 18, comprises a first locking flange 26*a* and a second locking flange 26*b* that are located on one end of said slide 26. Said slide also includes a pin-receiving aperture 26*c*. The first and second locking flanges 26*a* and 26*b* engage and secure the upper and lower rods 34 and 36 within the hydrostatic release 10. The slide 26 is substantially rectangular in shape and is hollow, having an open bottom, for receiving and fitting over the slide spring 24 when seated within channel 18*h*.

The sealing of the top housing 16 to the bottom housing 18 creates the interior chamber 40 in FIG. 8. As the vessel sinks, water enters through the water-intake apertures 18*k* of the bottom housing 18 and forces against the diaphragm 22*b*. The opposite of the diaphragm 22*d*, within the chamber 40 contains air which is exhausted out through the air-breathing aperture 16*g* during activation. In this manner, the pressure exerted by the water as a vessel 14 sinks to greater depths activates the pressure-actuated slide spring 24, which allows the upper rod 34 to be released. Once the upper rod 34 is released, the EPIRB 12 floats to the surface and emits a distress radio signal detected by satellites or other means, which relay the emergency signal to land-based rescue stations.

In FIG. 7, the piston diaphragm assembly 22 is fitted onto the planar circular portion 20*d* of the midplate bushing 20. The second aperture 20*e* of said midplate bushing 20 receives a pin 22*a* that is solidly attached to the center of the inferior surface 22*b* of the piston diaphragm assembly 22. A cylindrical piston 22*c* centrally-positioned and solidly attached to the superior surface 22*d* of the piston diaphragm assembly 22 is inserted into a first end 28*a* of the diaphragm spring 28. The plug retainer 32 is fitted over a second end 28*b* of the diaphragm spring 28 and the plug 30 is engaged with said plug retainer 32 on an opposing side of the plug retainer 32. Preferably, the plug 30 is constructed from P.T.F.E. or another similar material and is cylindrical in shape.

The lower rod 36 comprises a first end 36*a* and a second end 36*b*. The second end 36*b* protrudes from the bottom housing 18 of the hydrostatic release 10 once the top and bottom housings 16 and 18 are sealed together. Said second end 36*e* of the lower rod 36 includes a key feature 42 for locking the lower rod 36 to a bracket (not shown in the drawings) on the surface of the vessel or to an attachment means within a clam-shell shelter 44, as illustrate in FIGS. 10 through 12. The first end 36*a* of the lower rod 36 has a necked flange 36*c* comprising a small, preferably cylindrical, support shaft 36*d* that supports a centrally-positioned cylindrical plate 36*e*. The lower rod 36 further includes an aperture 36*f* that passes vertically through said second end 36*e*.

As shown in FIG. 8, the diameter of the cylindrical plate 36*d* of the necked flange 36*b* is greater than the diameter of the support shaft 36*c*. Immediately below the support shaft 36*c*, said first end 36*a* of the lower rod 36 has an annular flange 36*h* with a diameter that is also greater than the diameter of the support shaft 36*c*. The cylindrical plate 36*d* and annular flange 36*h* along with the support shaft $^{36}c$, which has a smaller diameter and is disposed solidly between said cylindrical plate 36*d* and annular flange 36*h* that are of greater diameters, forms a locking groove 36*h* that receives the first locking flange 26*a* of the slide 26.

The upper rod 34 of the hydrostatic release 10 also comprises a first end 34*a* (FIG. 7) and a second end 34*b* (FIG. 7). The first end 34*a* of the upper rod 34 includes a necked flange 34*c* that is comprised of a small, preferably cylindrical, support shaft 34*d* supporting a centrally-positioned cylindrical plate 34*e*. The diameter of the cylindrical plate 34*e* is greater than the diameter of the support shaft 34*d*. Likewise, immediately below the support shaft 34*d*, said first end 34*a* of the upper rod 34 has an annular flange 34*f* with a diameter that is also greater than the diameter of the support shaft 34*d*. The support shaft 34*d*, having a smaller diameter and being disposed solidly between the cylindrical plate 34*e* and annular flange 34*f* of larger diameters, forms a locking groove 34*g* that receives the second locking flange 26*b* of the slide 26. The second end 34*b* of the upper rod 34 protrudes from the top housing 16 of the hydrostatic release 10 once the top and bottom housings 16 and 18 are sealed together. The second end 34*b* of the upper rod 34 also includes an aperture 34*h* that passes horizontally through said second end 34*b* for receiving a cotter pin 50.

Figure 10:
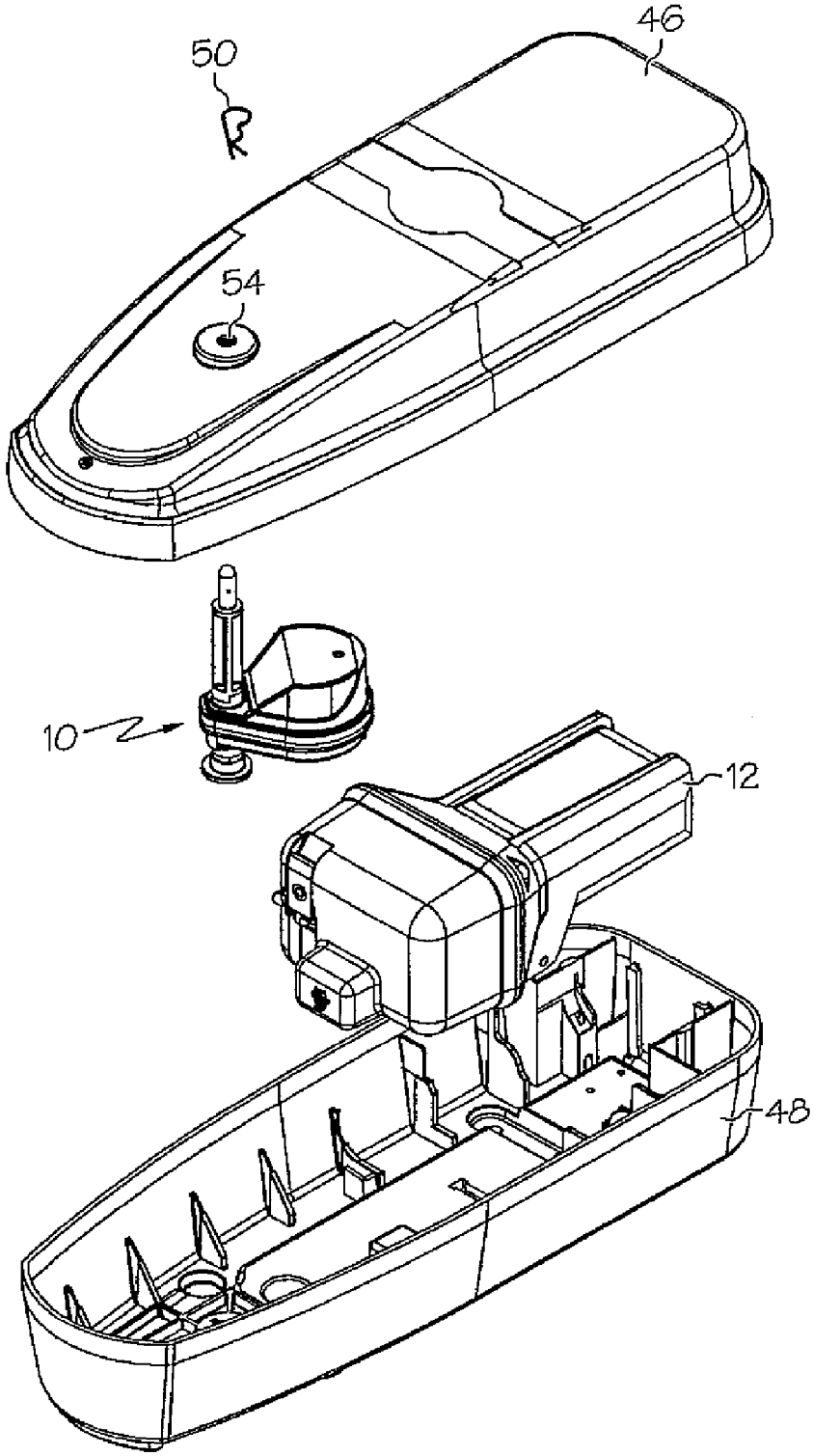
FIG. 10 shows an exploded view of a shelter and its housings, the hydrostatic release, the EPIRB, and a cotter pin.
Figure 11:
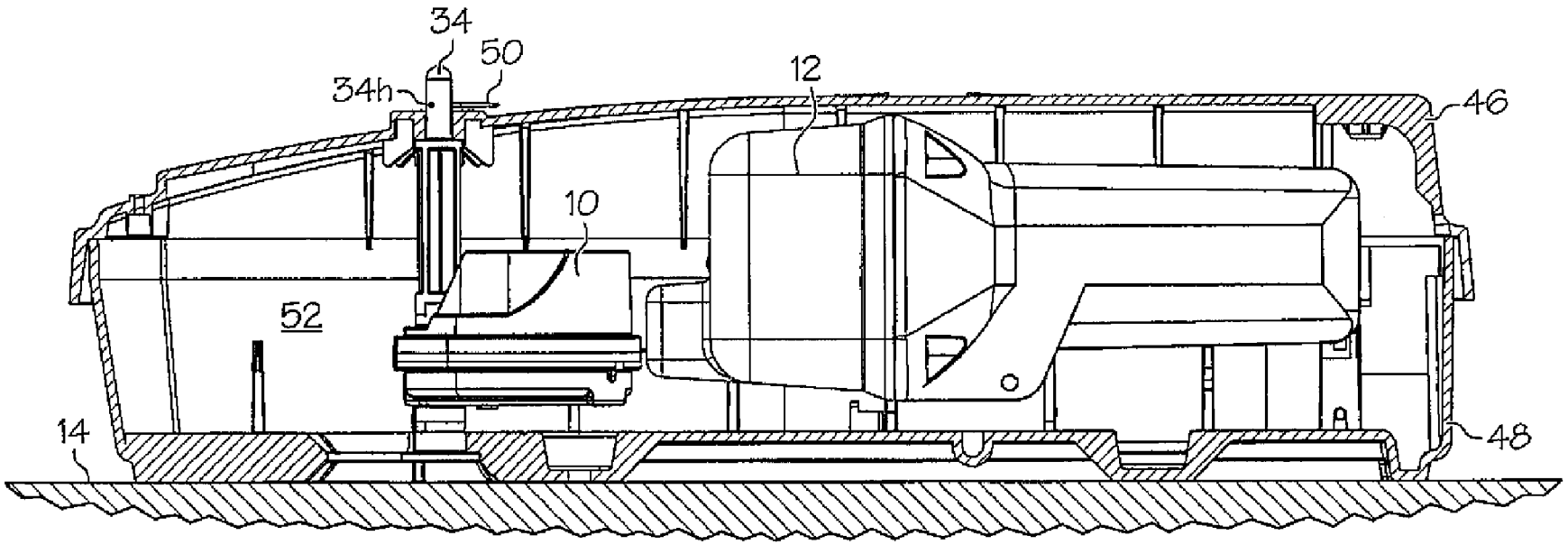
FIG. 11 shows a cut-away side elevational view of the sealed shelter with the hydrostatic release and EPIRB couched within said sealed shelter.
Figure 12:
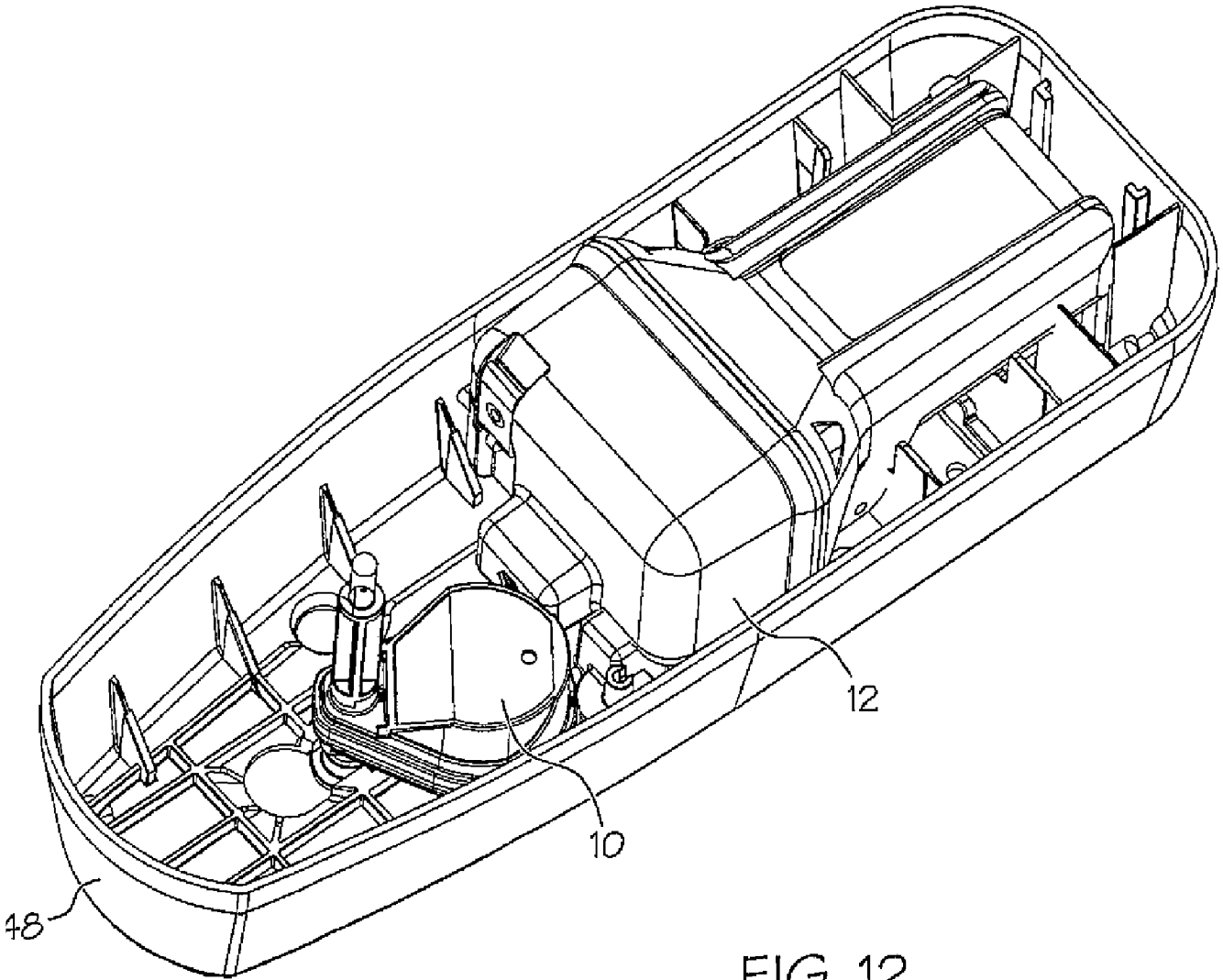
FIG. 12 shows a perspective view of the bottom housing of the shelter attached to the surface of a vessel and having the hydrostatic release and EPIRB couched within said bottom housing of the shelter.

As illustrated in FIGS. 10 through 12, the hydrostatic release 10 is housed within the clam-shell shelter 44, which protects both the EPIRB 12 and the hydrostatic release 10 from exposure to the elements and particularly from exposure to saltwater. The shelter 44 comprises a top housing 46, a bottom housing 48, a void 52 formed between the top and bottom housings 46 and 48 once assembled, and a rod aperture 54 located through a top surface of the top housing 46. The shelter 44 preferably is mounted on an exterior wall of the vessel 14 so as to be in an unobstructed location for releasing the buoyant EPIRB 12 should the vessel begin to sink. Both the EPIRB 12 and the hydrostatic release 10 are couched within the void 52 within shelter 44. The upper rod 34 of the hydrostatic release protrudes from the rod aperture 54 of the top housing 46. The cotter pin 50 is inserted through the aperture 34*h* of the upper rod 34 to secure the top housing 46 to the bottom housing 48 of the shelter 44. As the vessel 14 sinks and pressure increases as the depth of the sinking vessel increases, the hydrostatic release is activated and the upper rod 34 is released, thereby also releasing the top housing 46 of the shelter 44. Once the top housing 46 is released, the buoyant EPIRB 12 freely floats to the surface of the water.

The first locking flange 26*a* and second locking flange 26*b* of the slide 26 press in contact against the locking grooves 34*g* and 36*h* of the upper and lower rods 34 and 36, thereby securing the EPIRB 12 to the surface of the vessel 14. When water enters the release mechanism through water-intake aperture 18*k*, the resulting increase in pressure, caused by the sinking of the vessel 14 to greater and greater depths in the water column, actuates the diaphragm spring 28 and piston diaphragm assembly 22. The piston 22*c* moves in an upward stroke, thereby causing the simultaneous upward movement of the pin 22*a*. In moving upward, said pin 22*a* of the piston diaphragm assembly 22 disengages from the pin-receiving aperture 26*c* of the slide 26 by being withdrawn through said pin-receiving aperture 26*c* and through the second aperture 20*e* of the midplate bushing 20. Once the pin 22*a* of the piston diaphragm assembly 22 is removed, the compressed slide spring 24 uncoils and pushes the slide 26 from a first end 18*i* starting position, through the channel 18*h* of the bottom housing 18, and to a second end 18*j* of said channel 18*h* that is farthest from the upper and lower rods 34 and 36. At that instant, the first and second locking flanges 26*a* and 26*b* of slide 26 are also pushed away from said upper and lower rods 34 and 36. The upper rod 34 freely disengages from the hydrostatic release 10 and withdraws from the top housing aperture 16*c*. The EPIRB 12 then floats to the surface of the body of water.

The EPIRB is secured to the vessel during all violent motions to the vessel due to wave action but dependably releases the EPIRB in an emergency such as sinking.

The components of the hydrostatic release 10 may be ultrasonically welded together, which eliminates the need for additional manufacturing hardware and increases the speed of assembly of the devices. Two additional features of the hydrostatic release 10 allow the component and system integrity of each hydrostatic release mechanism to be tested for performance prior to shipment without replacing components, such as strings or lines that are cut through in conventional EPIRB releases. First, the hydrostatic release 10 allows non-destructive activation unlike conventional devices that employ knives, razors, or other mechanical cutting means to release an EPIRB. Secondly, the hydrostatic release cannot be reset by the user, which prevents tampering.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hydrostatic release for securing a first object to a second object and when subjected to a specific water pressure will release the first object from the second object comprising:

a hydrostatic release enclosure including a receptacle and a first passage;

a first rigid shaft having a portion mounted in said enclosure passage, said first shaft connectable to a first object;

a second rigid shaft having a portion mounted in said enclosure passage, said first shaft and said second shaft mounted in said enclosure passage coaxially end-to-end;

means for securing said first shaft to said second shaft in said enclosure passage;

forced generating means for creating a force based on a pre-determined pressure of water engulfing said force generating means mounted in said hydrostatic enclosure receptacle and connected to said first and second shaft securing means;

said force generating means includes a flexible diaphragm mounted inside said hydrostatic enclosure receptacle;

a spring attached to one side of said diaphragm to resist motion of said diaphragm in the direction of the spring;

said hydrostatic enclosure receptacle includes an inlet water flow passage in fluid communication with said diaphragm permitting ambient water to reach one side of said diaphragm on the opposite side from said spring whereby water pressure greater than the spring force will cause the diaphragm to move against the spring;

a slide having a first shaft end and second shaft end securing flange for securing said first shaft end to said second shaft end;

a slide spring for moving said slide against spring tension; and a slide locking pin connected to said diaphragm and said slide for holding said slide in a first position in the absence of water pressure against the diaphragm and for moving said pin when water pressure moves said diaphragm releasing said first and second shaft ends from each other.

2. A device as in claim 1, wherein:

said first object is an emergency position indicating radio beacon and said second object is a boat.

3. A device as in claim 1, including:

an EPIRB housing sized to receive an EPIRB;

a secured cover connectable to said EPIRB housing for covering said EPIRB housing in a closed position; and said EPIRB housing being said second object and said EPIRB housing cover being said first object, said EPIRB housing including at least one passage to emit water under pressure.

4. A device as in claim 3, including:

an EPIRB mounted inside said EPIRB housing and releasable underwater due to ambient water pressure.

5. A device as in claim 4, including:

means for attaching said EPIRB housing rigidly to a boat.

6. A hydrostatic activated release mechanism that is connected to a housing base for receiving an emergency position indicating radio beacon (EPIRB) and the housing cover for releasing the EPIRB underwater subject to a certain water pressure comprising:

a receptacle sized to receive an EPIRB having a base and four walls connected to said base forming an enclosure with a open top, the inside of said enclosure sized to receive an EPIRB and a hydrostatic release mechanism;

a hydrostatic release mechanism that has a first connector including a first shaft, said first connector connected to said EPIRB enclosure; and a cover for said EPIRB enclosure, said hydrostatic release mechanism including a second connector including a second shaft, said second connector connected to said EPIRB enclosure cover in a covered position with the EPIRB cover secured to said EPIRB enclosure with said hydrostatic release mechanism mounted inside said enclosure, said enclosure including a passage for allowing ambient water to flow into the enclosure, said hydrostatic release mechanism including a disconnect activated by ambient water pressure that disconnects the first connector first shaft from said second connector second shaft unsecuring the EPIRB cover from the EPIRB enclosure.

7. A device as in claim 6, including:

a fastener connected to said EPIRB enclosure for connecting said EPIRB enclosure to an object securely.

8. A device as in claim 7, wherein said object is a boat or ship.

* * * * *